US005335311A

United States Patent [19]

Groothuizen

[11] Patent Number: 5,335,311

[45] Date of Patent: Aug. 2, 1994

[54] MODULAR GALVANIC CURRENT CONTROL RESISTOR ASSEMBLY FOR MOUNTING ON AN ELECTRIC IMMERSION HEATER

[75] Inventor: Raymond T. Groothuizen, Kitchener, Canada

[73] Assignee: Glengarry Industries Ltd., Guelph, Canada

[21] Appl. No.: 5,969

[22] Filed: Jan. 19, 1993

[51] Int. Cl.[5] ..... F24H 1/20; H05B 3/82

[52] U.S. Cl. ..... 392/457; 204/197; 392/451; 392/455; 392/501; 338/315

[58] Field of Search ..... 392/457, 455, 449, 451, 392/501; 338/315; 204/197

[56] References Cited

U.S. PATENT DOCUMENTS

| | | | |
|---|---|---|---|
| 2,723,340 | 11/1955 | Boggs et al. | 392/457 |
| 2,810,815 | 10/1957 | Dicome | 392/457 X |
| 2,947,846 | 8/1960 | Fox | 392/457 X |
| 3,056,879 | 10/1962 | Fischer | 392/457 |
| 3,116,401 | 12/1963 | Drugmand | 392/457 X |
| 3,217,138 | 11/1965 | Drugmand | 392/457 |
| 4,152,578 | 5/1979 | Jacobs . | |
| 4,543,469 | 9/1985 | Cunningham | 392/457 |
| 4,848,616 | 7/1989 | Nozaki . | |

*Primary Examiner*—Anthony Bartis

*Attorney, Agent, or Firm*—Arne I. Fors; Jeffrey T. Imai

[57] ABSTRACT

A modular galvanic current control resistor assembly for application to a metallic sheathed heating element of a domestic water heating tank to prevent heating element corrosion includes a circular metallic disc adapted to fit over the sheath ends of a U-shaped immersion heating element protruding in electrically insulated relationship through a metallic screw plug or the like mounting means used to affix the heating element to the tank, an electrically insulating gasket coextensive with the disc and a galvanic current control resistor having a pair of leads. The sheath ends of the heating element extend through the gasket and disc with portions of the disc around each sheath end crimped, compressed or friction fitted into electrical contact therewith. The galvanic current control resistor is received in aligned openings in the disc and gasket and has one lead positioned between the disc and gasket and in electrical contact with the disc and its other lead extending through the opening to the other side of the gasket for electrical contact with the screw plug or like mounting means when the assembly is mounted thereon.

10 Claims, 4 Drawing Sheets

MODULAR GALVANIC CURRENT CONTROL RESISTOR ASSEMBLY FOR MOUNTING ON AN ELECTRIC IMMERSION HEATER

BACKGROUND OF THE INVENTION

The present invention relates to a resistor device for application to a heating element to reduce galvanic action produced in a container by an electrical heating element in which the heating element is used to heat the contents thereof.

Galvanic current flow normally exists between the sheath of the heating element and the wall of the water tank. Failure to control this current results in undue corrosion of the tank wall or sacrificial anode if present. By controlling this current flow, the tank's life can be extended. The particular embodiment of the present invention has been found to be successful in controlling such galvanic flow.

Resistor type devices are known to reduce this galvanic action. In U.S. Pat. No. 2,810,815 by Dicome, a partially exposed resistor is placed generally transverse to the mounting plate of the electric immersion heater apparatus. This patent discloses the construction of the heater assembly incorporating such resistor device. The resistor is built into a terminal block which is used to connect the heating element to the tank. The process of incorporating the resistor into a terminal block involves a number of steps, for example, a cap is required to be placed over the resistor and the terminals which extend from the sheath of the heating element.

Patents such as U.S. Pat. No. 2,947,846 by J. J. Fox relate to heating elements using resistors incorporated in a mounting block structure by soldering, brazing or the like. The correlation between the components of the structure such as the mounting plate and the clamping plate must be maintained to permit proper installation.

The present invention allows the resistor device to be applied as an individual sub-assembly package. This obviates the need for integration of the resistor into other subcomponents and does not require a costly brazing operation.

The resistor device of the present invention may be used in connection with any standard terminal block. Unlike previous devices, the present invention is able to provide resistor type corrosion protection in applications lacking a terminal block or brazed-type compositions.

Conventional heating apparatus generally consist of a heating element of the hairpin type of U-shaped configuration comprising a metal tubular sheath enclosing a heating resistance coil. The heating element sheath conventionally is composed of copper, Type 300 stainless steel, or the like. The heating element is immersed in the liquid to be heated contained in the tank. The terminal portions of the electrical resistance heater are connected to the tank by a screw plug or like mounting means.

SUMMARY OF THE INVENTION

The present invention comprises a resistor device for reducing stray galvanic current flow occurring in a container in which an electric heating element is used to heat the contents thereof. The resistor device is circular in design and fits over the protrusion of the electric element through the screw plug. A plurality of equispaced radial slits allow flexing of metal therebetween as the resistor device is pressed onto the protruding metal sheath of the electric heating element, thereby forming a snug friction fit. The resistor device is comprised of a metal disc, an insulating gasket and a resistor. The insulating gasket is coextensive with and abuts the metal disc. The resistor has a pair of leads. One of the leads is disposed between the metal disc and the gasket for electrical contact with the metal disc and the other lead extends through an opening in the gasket for abutment against the opposite side of the gasket. Thus, the electrical path from the heating element to the screw plug passes through the resistor and is controlled.

In a first embodiment, the resistor device comprises a metal disc, an insulating gasket co-extensive with said metal disc and abutting said metal disc, a resistor having a pair of leads, an opening formed in said metal disc and an opening in said gasket for receiving said resistor, one of said leads being disposed between said metal disc and said gasket for electrical contact within said metal disc, the other lead extending through the opening in said gasket for abutment against the opposite side of said gasket, said metal disc and gasket having a pair of openings formed therein for receiving the heating element in frictional engagement, whereby upon mounting of the device upon the heating element extending through mounting means for the container, electrical conductivity is effected between the said sheath ends and said mounting means.

In one embodiment of the invention, said openings are two extruded holes. The extrusions are preferably crimped or compression fitted to the sheath ends providing the required path of electrical conductivity.

In a preferred embodiment, the resistor device of the invention comprises a metal disc, an insulating gasket co-extensive with said metal disc and abutting said metal disc, a resistor having a pair of leads, an opening formed in said metal disc and an opening in said gasket for receiving said resistor, one of said leads being disposed between said metal disc and said gasket for electrical contact within said metal disc, the other lead extending through the opening for abutment against the opposite side of said gasket, said metal disc and gasket having a pair of raised openings formed therein for receiving the heating element, said openings preferably having a plurality of radial slits formed therein to allow flexing of the metal disc adjacent said opening for a snug friction fit of said metal disc over the said sheath ends therewith, whereby upon mounting of the device upon the heating element extending through a screw plug for the container, electrical conductivity is effected between the said heating element sheath and said screw plug.

The various features of the invention are more particularly shown in the claims which form a part of this disclosure. For a better understanding of the advantages and objects of the invention reference should be made to the accompanying drawings and the following descriptive matter which illustrates the preferred embodiments of the invention.

BRIEF DESCRIPTION OF THE DRAWINGS

The preferred embodiments of the invention will now be described with the aid of the following drawings, in which.

DETAILED DESCRIPTION OF THE PREFERRED EMBODIMENT

Figure 1:
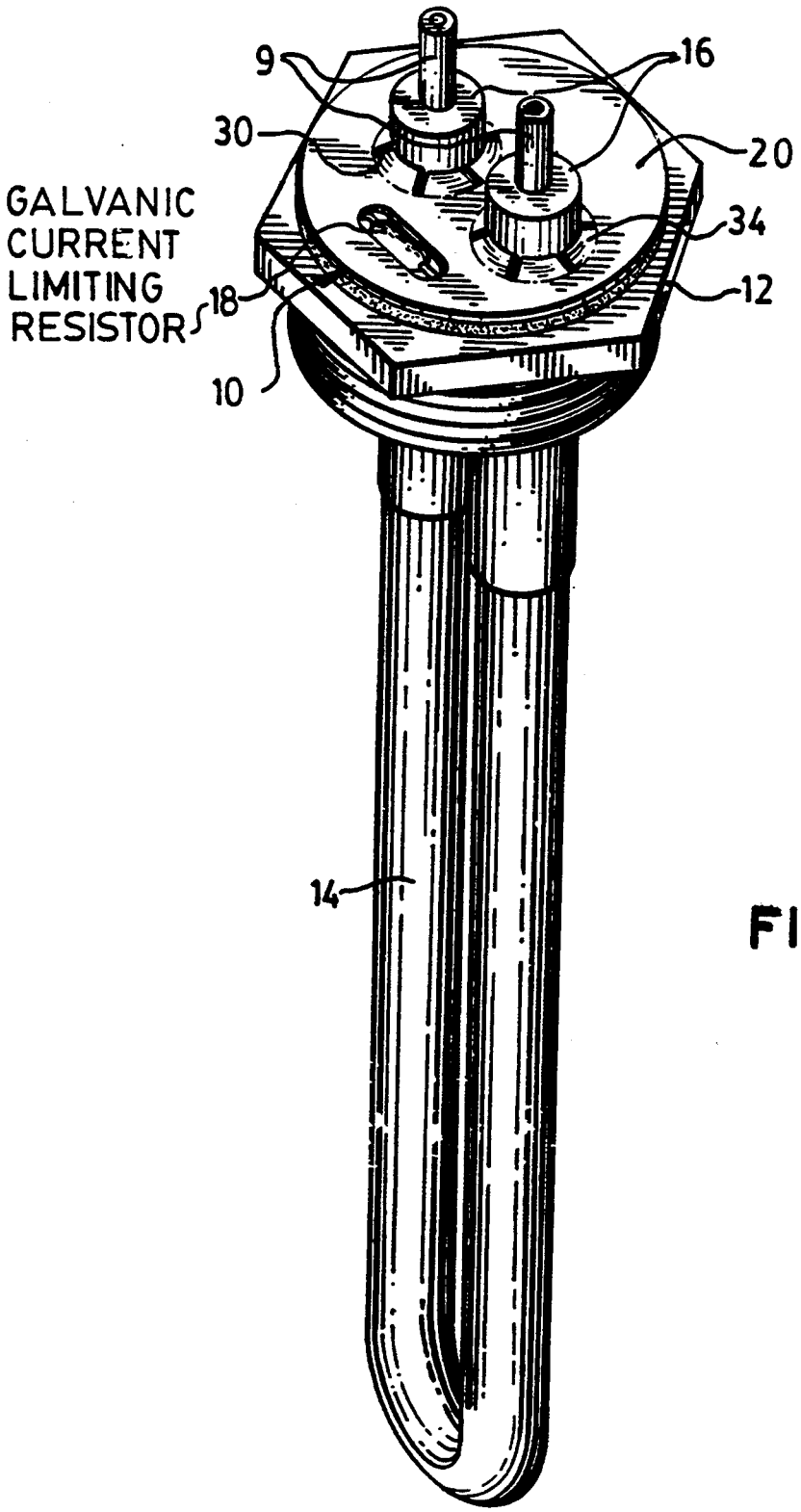
FIG. 1 is a perspective view of a heater assembly with the resistor device of the invention attached.
Figure 2:
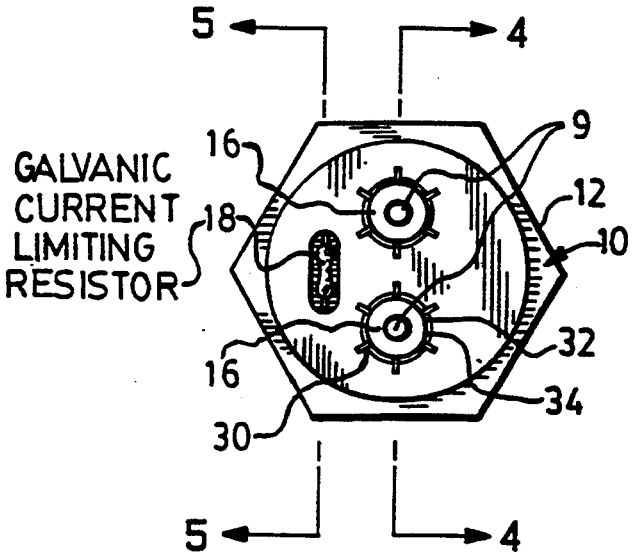
FIG. 2 is a top plan view of the resistor device.
Figure 3:
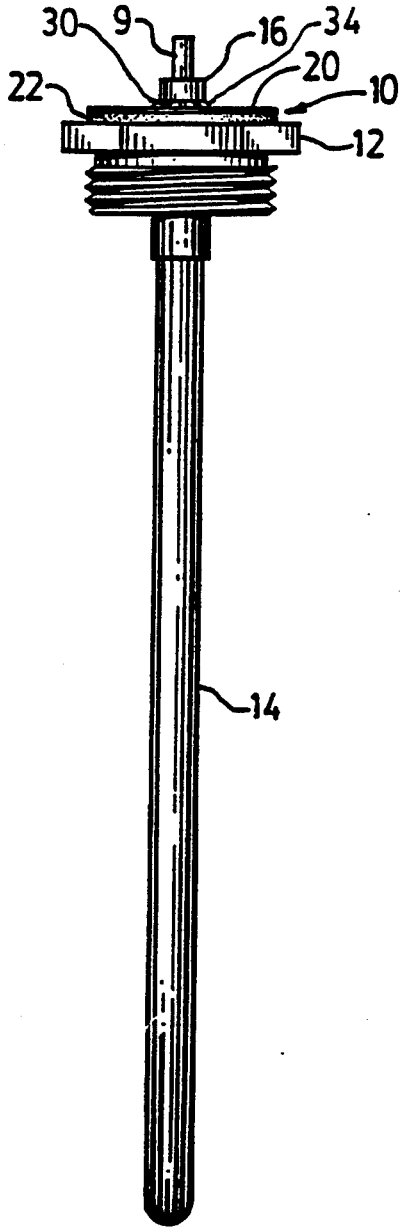
FIG. 3 is a side view of the heating apparatus and resistor device.

Referring to the drawings, FIGS. 1, 2 and 3 show the resistor device 10 on the screw plug 12 and its location in relation to the electric heating element 14 having a metal sheath 15 such as copper enveloping the contacts 9 of the heating resistance coil (not shown) and sheath ends 16 insulated from the screw plug 12 by insulating plastic bushings or sleeves 17. The longitudinally U-shaped heating element 14 is placed within the water tank and warms up the water therein.

Figure 4:
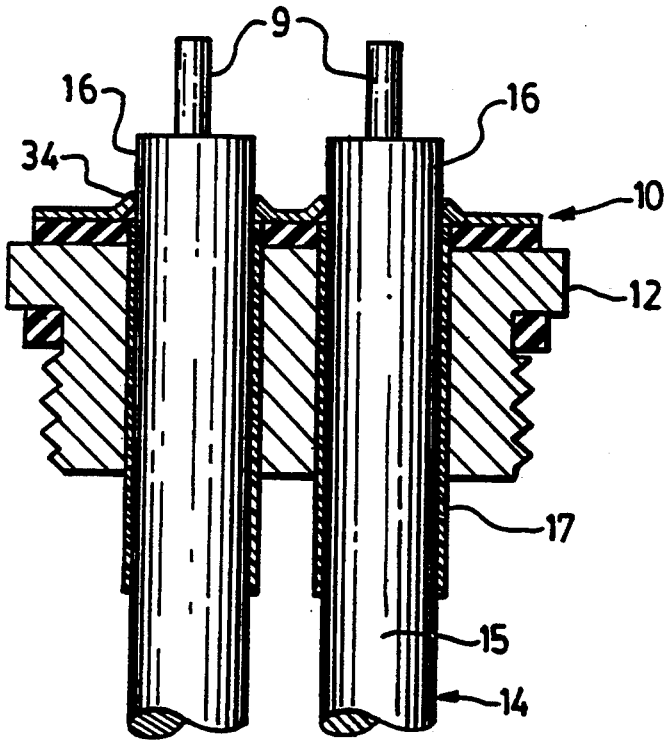
FIG. 4 is a fragmentary cross sectional view of the modular resistor, screw plug and heating element as viewed along the 4—4 axis of FIG. 2.
Figure 5:
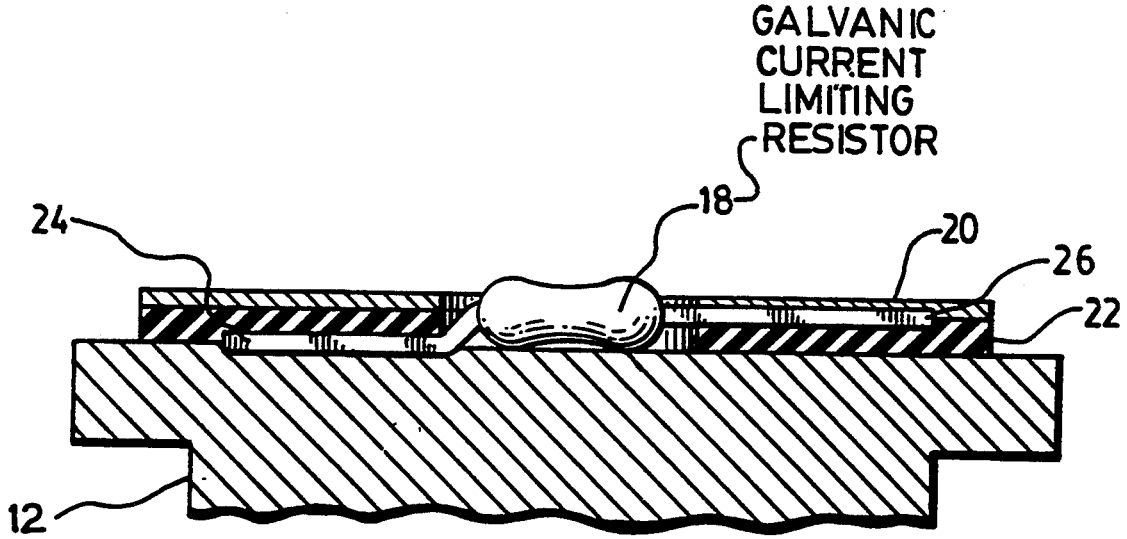
FIG. 5 is a fragmentary cross-sectional view of the resistor device along the 5—5 axis of FIG. 2.

Referring now more particularly to FIGS. 4 and 5, the resistor device comprises a galvanic current control resistor 18, metal disc 20 and an insulating gasket 22 co-extensive with the metal disc 20. This insulating gasket may be comprised of electrical fibre. One lead 24 from the resistor makes electrical contact with the screw plug 12 and the other lead 26 makes contact with metal disc 20. Insulating gasket 22 is placed between metal disc 20 and the screw plug 12 such that the only electrical path between the two is through the resistor. Metal disc 20 is secured to the metal sheath 15 by means of pressing it over the sheath ends 16. Metal disc 20 may be composed of spring temper stainless steel, nickel-plated mild steel, tin-plated mild steel, or another suitable metal.

Metal disc 20, as viewed in FIGS. 1–4 has a plurality of equispaced radial slits 30 formed about raised openings 32 having shoulder 34 to allow flexing of the metal disc over the sheath ends 16 and to provide a good electrical-mechanical connection therewith.

Figure 6:
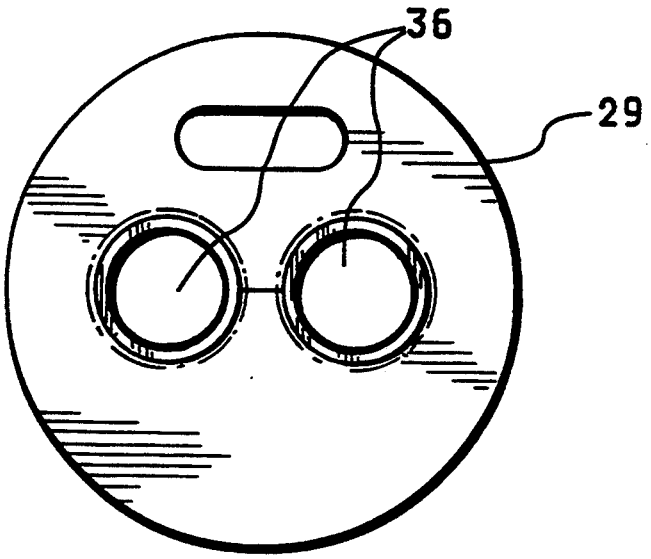
FIG. 6 is a plan view of a further embodiment of metal disc.
Figure 7:
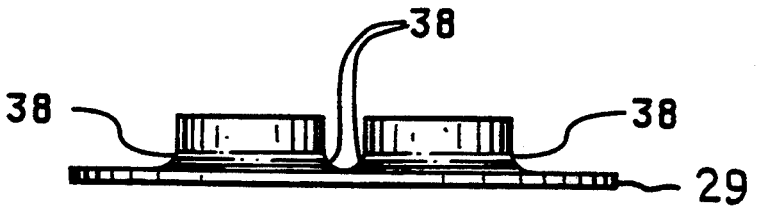
FIG. 7 is a side elevation thereof.

With reference to FIGS. 6 and 7, metal disc 29 has raised openings 36 with a continuous annular shoulder 38 adapted to be crimped or compression fitted onto sheath ends 16.

The electric circuit runs from lead 24 in abutment with screw plug 12 through the resistor 18 to lead 26 where it meets the metal disc 20 in contact with sheath ends 16 of electric element 14, thereby controlling galvanic current flow from the electric element 14 to the screw plug 12.

The present invention provides a number of important advantages. The resistor device is provided as a sub-assembly which can be readily manually pressed onto the electric element and locked in place to provide positive electrical continuity between the heating element and screw plug, which is in turn electrically connected with the tank. Potential stray galvanic current flows are channelled through the screw plug to the tank wall, thereby minimizing corrosion of the tank.

The embodiments of the invention in which an exclusive property or privilege is claimed are defined as follows:

1. A resistor device for application to a U-shaped heating element having a pair of sheath ends projecting through mounting means for a container to reduce galvanic action produced in the container by said heating element in which said heating element is used to heat the contents thereof, comprising a metal disc, an insulating gasket co-extensive with said metal disc and abutting said metal disc, a resistor having a pair of leads, an opening formed in said metal disc and aligned with an opening in said gasket, said aligned openings receiving said resistor, one of said leads being disposed between said metal disc and said gasket for electrical contact within said metal disc, the other lead extending through the opening in said gasket into abutment against the opposite side of said gasket, said metal disc and gasket each having a pair of openings formed therein for receiving sheath ends of the heating element in frictional engagement therewith whereby upon mounting of the device upon the sheath ends of the U-shaped heating element extending in electrically insulative relationship through the mounting means for the container, electrical conductivity is effected between said sheath ends and said mounting means through said resistor.

2. A resistor device as claimed in claim 1 wherein said mounting means is a screw plug.

3. A resistor device as claimed in claim 2 wherein said insulating gasket is comprised of electrical fibre.

4. A resistor device as claimed in claim 1 wherein said metal disc is selected from the group consisting of spring temper stainless steel, nickel-plated mild steel or tin-plated mild steel.

5. A resistor device as claimed in claim 3 wherein the portion of the metal disc surrounding each of the openings formed in the metal disc has a plurality of radial slits formed therein to allow flexing of the metal disc adjacent the opening for a snug friction fit of said metal disc over the sheath ends of the U-shaped heating element.

6. A resistor device as claimed in claim 3 wherein the portion of the metal disc surrounding each of the openings formed in the metal disc comprises a raised annular shoulder adapted to be crimped or compression fitted into good electrical contact with the sheath ends of the heating element.

7. A resistor device for application to a U-shaped heating element having a pair of sheath ends to reduce galvanic action produced in a container by said heating element in which said heating element is used to heat the contents thereof, comprising a metal disc, an insulating gasket co-extensive with said metal disc and abutting said metal disc, a resistor having a pair of leads, an opening formed in said metal disc and aligned with an opening in said gasket, said aligned openings receiving said resistor, one of said leads being disposed between said metal disc and said gasket for electrical contact within said metal disc, the other lead extending through the opening in the gasket into abutment against the opposite side of said gasket, said metal disc and gasket each having a pair of openings formed therein for receiving the sheath ends of the heating element in frictional engagement therewith, the portion of said disc surrounding each of said openings having a plurality of radial slits formed therein to allow flexing of the metal disc adjacent said opening for a snug friction fit of said metal disc over the sheath ends of said heating element, whereby upon mounting of the device upon the sheathed ends of a U-shaped heating element extending through and electrically insulated from a metallic screw plug for the container, electrical conductivity is effected between the said sheath ends and said screw plug through said resistor.

8. A resistor device as claimed in claim 7 wherein said metal disc is selected from the group consisting of spring temper stainless steel, nickel-plated mild steel or tin-plated mild steel.

9. A resistor device as claimed in claim 8 wherein said insulating gasket is comprised of electrical fibre.

10. A resistor device for application to a U-shaped heating element having a pair of sheath ends to reduce galvanic action produced in a container by said heating element in which said heating element is used to heat the contents thereof, comprising a metal disc, an insulating gasket co-extensive with said metal disc and abutting said metal disc, a resistor having a pair of leads, an opening formed in said metal disc and aligned with an opening in said gasket, said aligned openings receiving said resistor, one of said leads being disposed between said metal disc and said gasket for electrical contact within said metal disc, the other lead extending through the opening in the gasket into abutment against the opposite side of said gasket, said metal disc and gasket each having a pair of openings formed therein for receiving the sheath ends of the heating element in frictional engagement therewith, the portion of said disc surrounding each of said openings comprising a raised annular shoulder adapted to be crimped or compression fitted into electrical engagement with the sheath ends of the heating element whereby upon mounting and crimping or compression fitting of the device upon the sheathed ends of a U-shaped heating element extending through and electrically insulated from a metallic screw plug for the container, electrical conductivity is effected between the said sheath ends and said screw plug through said resistor.

* * * * *